US010321234B2

(12) United States Patent
Kon

(10) Patent No.: US 10,321,234 B2
(45) Date of Patent: Jun. 11, 2019

(54) SIGNAL PROCESSING DEVICE AND SIGNAL PROCESSING METHOD

(71) Applicant: SONY CORPORATION, Tokyo (JP)

(72) Inventor: Homare Kon, Tokyo (JP)

(73) Assignee: SONY CORPORATION, Tokyo (JP)

( * ) Notice: Subject to any disclaimer, the term of this patent is extended or adjusted under 35 U.S.C. 154(b) by 1 day.

(21) Appl. No.: 15/523,399

(22) PCT Filed: Nov. 6, 2015

(86) PCT No.: PCT/JP2015/081268
§ 371 (c)(1),
(2) Date: Apr. 30, 2017

(87) PCT Pub. No.: WO2016/080204
PCT Pub. Date: May 26, 2016

(65) Prior Publication Data

US 2017/0325026 A1 Nov. 9, 2017

(30) Foreign Application Priority Data

Nov. 18, 2014 (JP) ..... 2014-233311

(51) Int. Cl.
*H04R 1/24* (2006.01)
*H04R 3/04* (2006.01)
(Continued)

(52) U.S. Cl.
CPC ..... *H04R 3/14* (2013.01); *H04R 1/24* (2013.01); *H04R 3/04* (2013.01); *H04S 5/00* (2013.01); *H04S 2420/13* (2013.01)

(58) Field of Classification Search
CPC ... H04R 3/14; H04R 3/04; H04R 1/24; H04R 2203/12; H04R 2201/40; H04R 2201/401;
(Continued)

(56) References Cited

U.S. PATENT DOCUMENTS 9,031,267 B2 * 5/2015 Johnston ..... H04R 3/12 381/104
2004/0151325 A1 * 8/2004 Hooley ..... F41H 13/0081 381/18
(Continued)

FOREIGN PATENT DOCUMENTS

JP 2005-184040 A 7/2005
JP 2007-236005 A 9/2007
(Continued)

*Primary Examiner* — Davetta W Goins
*Assistant Examiner* — Daniel R Sellers
(74) *Attorney, Agent, or Firm* — Chip Law Group

(57) ABSTRACT

The present disclosure relates to a signal processing device, a signal processing method, and a program that allows for generating an input signal suitable for a multi-way speaker. A band dividing unit divides an audio signal into signals in a plurality of bands corresponding to respective bands of a plurality of speaker units of the multi-way speaker. A filter processing unit performs wave front synthesis filter processing on each of the audio signals in the respective bands having been divided into. The audio signal in each of the bands after the wave front synthesis filter processing is supplied to the speaker unit of the corresponding band in the multi-way speaker. The present disclosure is applicable, for example, to a signal processing device or other devices.

7 Claims, 7 Drawing Sheets

(51) Int. Cl.
*H04R 3/14* (2006.01)
*H04S 5/00* (2006.01)

(58) Field of Classification Search
CPC ..... H04R 2201/403; H04R 2201/405; H04S 2420/07; H04S 2420/13; H04S 7/301; H04S 7/302; H04S 7/308
See application file for complete search history.

(56) References Cited

U.S. PATENT DOCUMENTS

| | | | | |
|---|---|---|---|---|
| 2004/0223620 | A1* | 11/2004 | Horbach | H04R 29/002 381/59 |
| 2006/0280311 | A1* | 12/2006 | Beckinger | H04S 3/00 381/17 |
| 2011/0261973 | A1* | 10/2011 | Nelson | H04S 3/00 381/92 |
| 2012/0008812 | A1* | 1/2012 | Sporer | H04R 1/26 381/335 |
| 2013/0101144 | A1* | 4/2013 | Hattori | H04R 3/12 381/182 |

FOREIGN PATENT DOCUMENTS

| | | | |
|---|---|---|---|
| JP | 2012-010011 | A | 1/2012 |
| JP | 2014-053864 | A | 3/2014 |

* cited by examiner

SIGNAL PROCESSING DEVICE AND SIGNAL PROCESSING METHOD

CROSS REFERENCE TO RELATED APPLICATIONS

This application is a U.S. National Phase of International Patent Application No. PCT/JP2015/081268 filed on Nov. 6, 2015, which claims priority benefit of Japanese Patent Application No. JP 2014-233311 filed in the Japan Patent Office on Nov. 18, 2014. Each of the above-referenced applications is hereby incorporated herein by reference in its entirety.

TECHNICAL FIELD

The present disclosure relates to signal processing devices, signal processing methods, and programs and particularly to a signal processing device, a signal processing method, and a program that allows for generating an input signal suitable for a multi-way speaker.

BACKGROUND ART

Wave front synthesis technique is known as a sound field reproduction method to acquire a wave front of sound in a sound field by a plurality of microphones and to reproduce the sound field on the basis of the acquired sound signal. As one type of the wave front synthesis technique, there is a boundary surface control method (for example, see Patent Document 1).

The boundary surface control method is a method to arrange microphones in a reproduction space where the sound field is reproduced in the same manner as that in the original space where a sound source has been acquired and to provide input signals to a plurality of speakers installed in the periphery of the reproduction space such that signals observed by the microphones are the same as microphone signals acquired in the original space.

In this boundary surface control method, a speaker that outputs a spherical wave in every frequency band is ideal as the plurality of speakers installed in the periphery of the reproduction space; however, no such speaker exists in reality.

Therefore, generally used is a multi-way speaker where a plurality of units is included in one enclosure to support by dividing into a plurality of bands such as a high frequency band side and a low frequency band side.

CITATION LIST

Patent Document

Patent Document 1: Japanese Patent Application Laid-Open No. 2012-10011

SUMMARY OF THE INVENTION

Problems to be Solved by the Invention

In a multi-way speaker, a deemed acoustic axis determined by weighing a unit of the high frequency band or by other means is set. However, this is different from actual acoustic axes of the respective units and thus an effect of wave front synthesis may not be fully exercised. Therefore there is a need to consider input appropriate for a multi-way speaker.

The present disclosure has been devised in consideration to the above circumstances to allow for generation of an input signal suitable for a multi-way speaker.

Solutions to Problems

A signal processing device of one aspect of the present disclosure includes: a band dividing unit that divides an audio signal into signals in a plurality of bands corresponding to respective bands of a plurality of speaker units of a multi-way speaker; and a wave front synthesis filter processing unit that performs wave front synthesis filter processing on each of the audio signals in the respective bands having been divided into. The audio signal in each of the bands after the wave front synthesis filter processing is output to the speaker unit of the corresponding band in the multi-way speaker.

A signal processing method of one aspect of the present disclosure includes the steps of: dividing, by a signal processing device, an audio signal into signals in a plurality of bands corresponding to respective bands of a plurality of speaker units of a multi-way speaker; and performing, by the signal processing device, wave front synthesis filter processing on each of the audio signals in the respective bands having been divided into. The audio signal in each of the bands after the wave front synthesis filter processing is output to the speaker unit of the corresponding band in the multi-way speaker.

A program of one aspect of the present disclosure causes a computer to function as: a band dividing unit that divides an audio signal into signals in a plurality of bands corresponding to respective bands of a plurality of speaker units of a multi-way speaker; and a wave front synthesis filter processing unit that performs wave front synthesis filter processing on each of the audio signals in the respective bands having been divided into. The audio signal in each of the bands after the wave front synthesis filter processing is output to the speaker unit of the corresponding band in the multi-way speaker.

In one aspect of the present disclosure, an audio signal is divided into signals in the plurality of bands corresponding to the respective bands of the plurality of speaker units of the multi-way speaker and the wave front synthesis filter processing is performed on each of the audio signals in the respective bands having been divided into.

Note that the program can be provided by transmission via a transmission medium or being stored in a recording medium.

The signal processing device may be an independent device or an internal block included in a device.

Effects of the Invention

An aspect of the present disclosure allows for generation of an input signal suitable for a multi-way speaker.

Note that effects described herein are not necessarily limiting. Any one of the effects described in the present disclosure may be included.

MODE FOR CARRYING OUT THE INVENTION

<Explanation on Boundary Surface Control Method>

First, the boundary surface control method will be described with reference to FIG. 1.

The boundary surface control method is a method to arrange microphones in a reproduction space where the sound field is reproduced in the same manner as that in the original space where a sound source has been acquired and to provide input signals to a plurality of speakers installed in the periphery of the reproduction space such that signals observed by the microphones are the same as microphone signals acquired in the original space.

Figure 1:
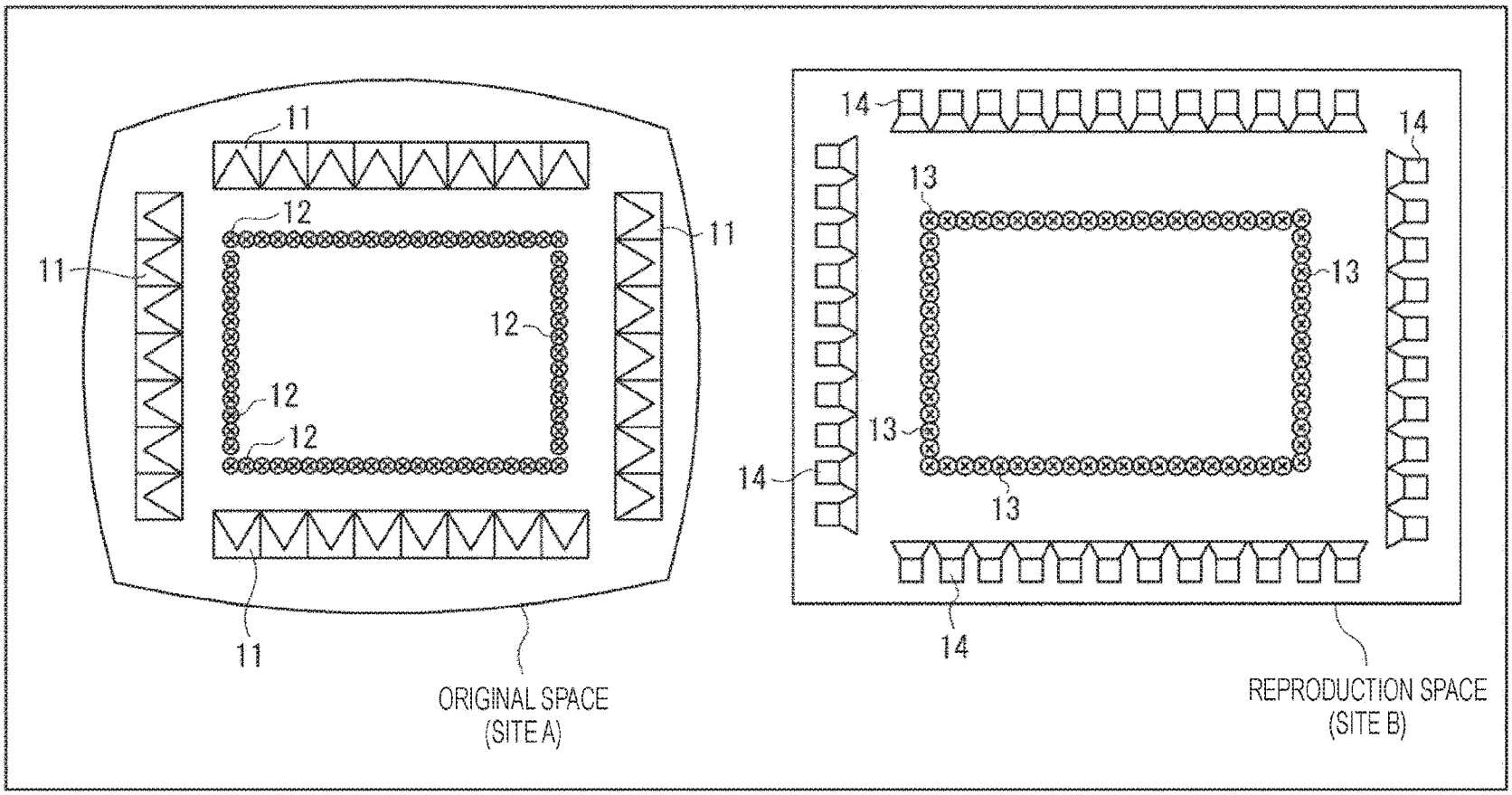
FIG. 1 is a diagram explaining a boundary surface control method.

Specifically, a site A illustrated in FIG. 1 is assumed as the original space. Sound output from a number of speakers 11 arranged in the periphery of the site A is acquired by a number of microphones 12 arrayed in the site.

Moreover, in a site B as a reproduction space, a number of microphones 13 are installed in arrangement similar to that in the original space as illustrated in FIG. 1. A reproduction device measures a transmission function (transmission characteristic) G from the multiple speakers 14 arranged in the periphery to the respective microphones 13. The reproduction device then calculates an inverse function filter $H=G^{-1}$ which is inverse characteristic of the transmission function G and outputs, from the speaker 14, the audio signal acquired in the original space through the inverse function filter H, thereby reproducing the sound field of the original space in the reproduction space. A position of the microphone 12 or 13 is also referred to as a control point in the boundary surface control method.

Note that actually it is often difficult to measure a transmission function G from the multiple speakers 14 to the respective microphones 13 by installing the multiple microphones 13 in the reproduction space. Therefore there are cases where the transmission function G is derived from simulation calculation using a theoretical value.

<Exemplary Configuration of Reproduction System>

Figure 2:
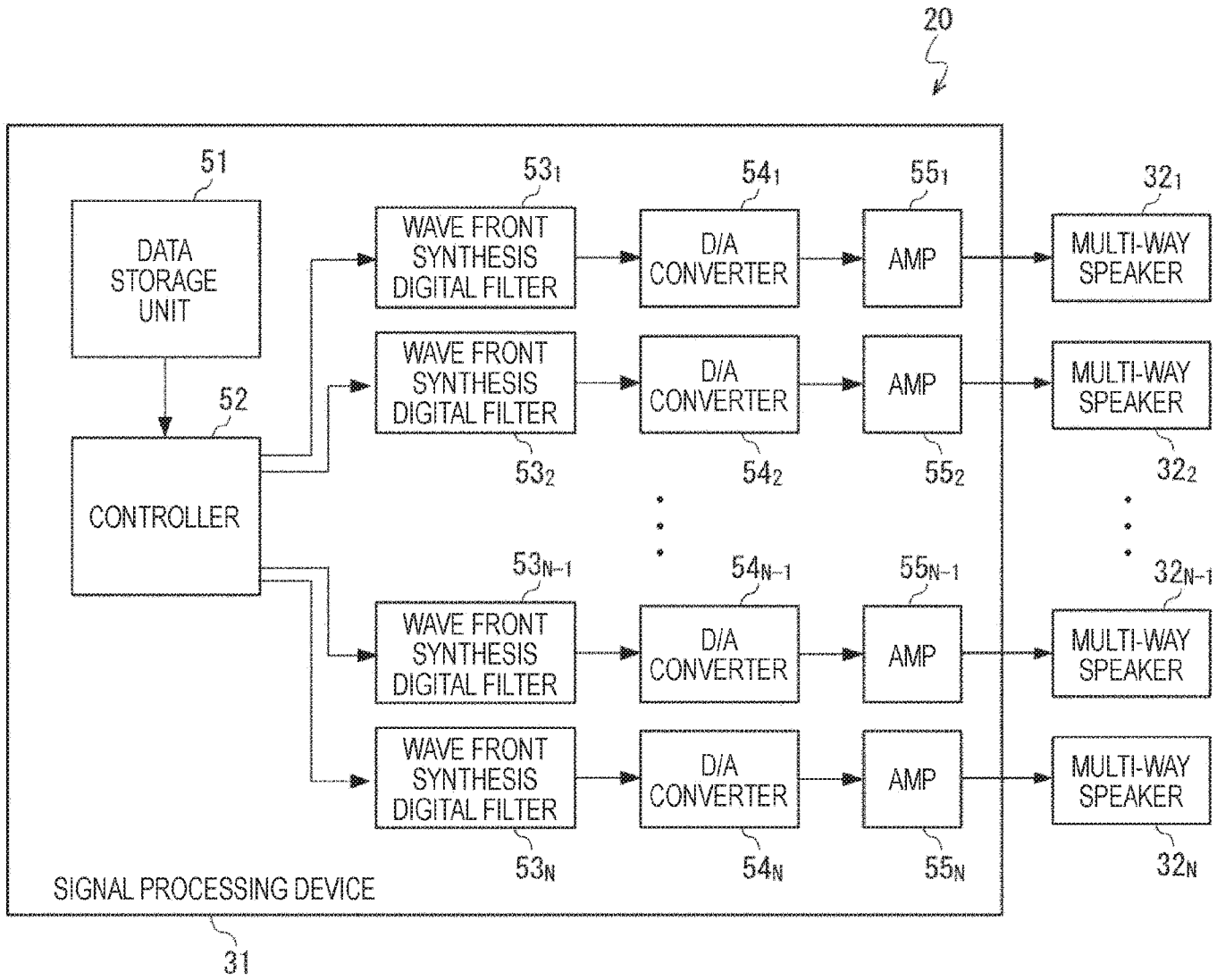
FIG. 2 is a block diagram illustrating an exemplary configuration of an embodiment of a contents presentation device according to the present disclosure.

FIG. 2 is a diagram illustrating an exemplary configuration of an embodiment of a reproduction system according to the present disclosure.

A reproduction system 20 in FIG. 2 is a system used for reproduction of a sound field by the boundary surface control method and includes a signal processing device 31 and multiple (N) multi-way speakers 32.

The signal processing device 31 corresponds to the reproduction device that generates and outputs the audio signal to be provided to the speaker 14 in the reproduction space having described in FIG. 1. The multi-way speaker 32 corresponds to the speaker 14.

In the present embodiment, the multi-way speaker 32 includes, in one enclosure, two units including a unit that supports a low frequency band (woofer) and a unit that supports a high frequency band (tweeter).

Generally, a specification of a multi-way speaker describes about an acoustic axis. An acoustic axis of a multi-way speaker described in a specification is a deemed acoustic axis where a unit of the high frequency band side is weighted to determine a single acoustic axis as illustrated in FIG. 3A.

Figure 3B:
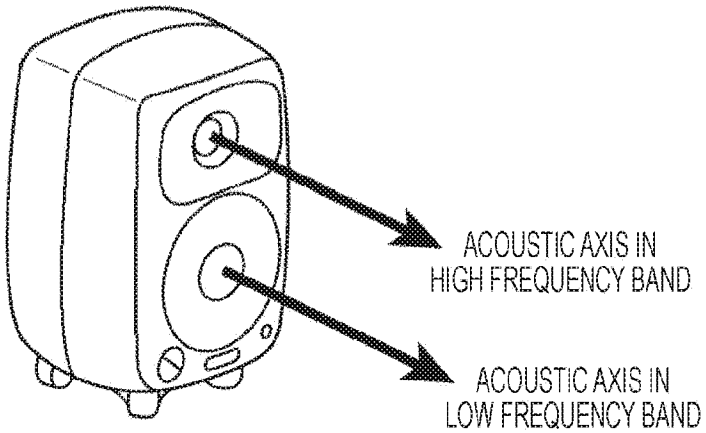
FIGS. 3A and 3B are diagrams explaining an acoustic axis of a multi-way speaker.
Figure 3A:
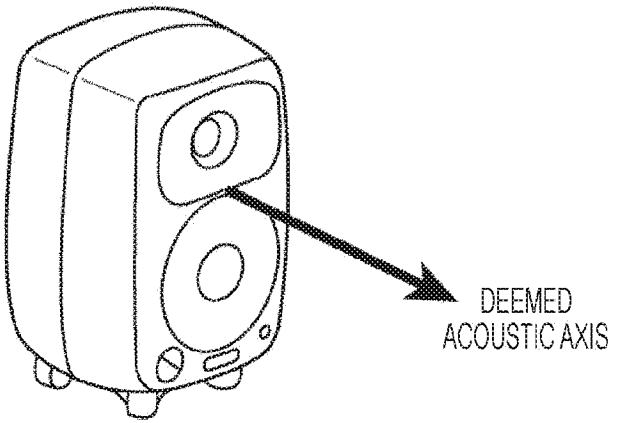

However, an acoustic axis of a multi-way speaker is actually different between a unit of the high frequency band side and a unit of the low frequency band side as illustrated in FIG. 3B.

The signal processing device 31 performs signal processing corresponding to each of an acoustic axis in the high frequency band and an acoustic axis in the low frequency band of the multi-way speaker 32. Here a crossover frequency between the high frequency band and the low frequency band of the multi-way speaker 32 is assumed as 300 Hz.

In FIG. 2, the signal processing device 31 includes a data storage unit 51, a controller 52, wave front synthesis digital filters $\mathbf{53}_1$ to $\mathbf{53}_N$, D/A converters $\mathbf{54}_1$ to $\mathbf{54}_N$, and amplifiers (AMPS) $\mathbf{55}_1$ to $\mathbf{55}_N$.

Note that the wave front synthesis digital filters $\mathbf{53}_1$ to $\mathbf{53}_N$, the D/A converters $\mathbf{54}_1$ to $\mathbf{54}_N$, and the amplifiers (AMPS) $\mathbf{55}_1$ to $\mathbf{55}_N$ are N systems of the wave front synthesis digital filter 53, the D/A converter 54, and the amplifier 55 provided corresponding to N multi-way speakers $\mathbf{32}_1$ to $\mathbf{32}_N$.

The data storage unit 51 stores an audio signal acquired in an original space.

The controller 52 acquires, from the data storage unit 51, an audio signal of a sound source instructed by a user at an operation unit (not illustrated) and supplies the audio signal to the wave front synthesis digital filters $\mathbf{53}_1$ to $\mathbf{53}_N$.

The wave front synthesis digital filters $\mathbf{53}_i$ (i=1 to N), the D/A converters $\mathbf{54}_i$, and the amplifiers $\mathbf{55}_i$ form a processing system that processes the audio signal to be output to the multi-way speakers $\mathbf{32}_i$. The wave front synthesis digital filter 53, the D/A converter 54, and the amplifier 55 execute similar signal processing in each of the systems and thus description is given on one wave front synthesis digital filter 53, one D/A converter 54, and one amplifier 55.

The wave front synthesis digital filter 53 executes filter processing of the inverse function filter $H=G^{-1}$ of the transmission function G in a reproduction space on the audio signal supplied from the controller 52 and supplies the audio signal after the filter processing to the D/A converter 54.

The D/A converter 54 converts the digital audio signal supplied from the wave front synthesis digital filter 53 into an analog signal and supplies the analog signal to the amplifier 55.

The amplifier 55 amplifies the analog audio signal supplied from the D/A converter 54 and outputs to the multi-way speaker 32 connected therewith.

<Detailed Configuration of Wave Front Synthesis Digital Filter>

Figure 4:
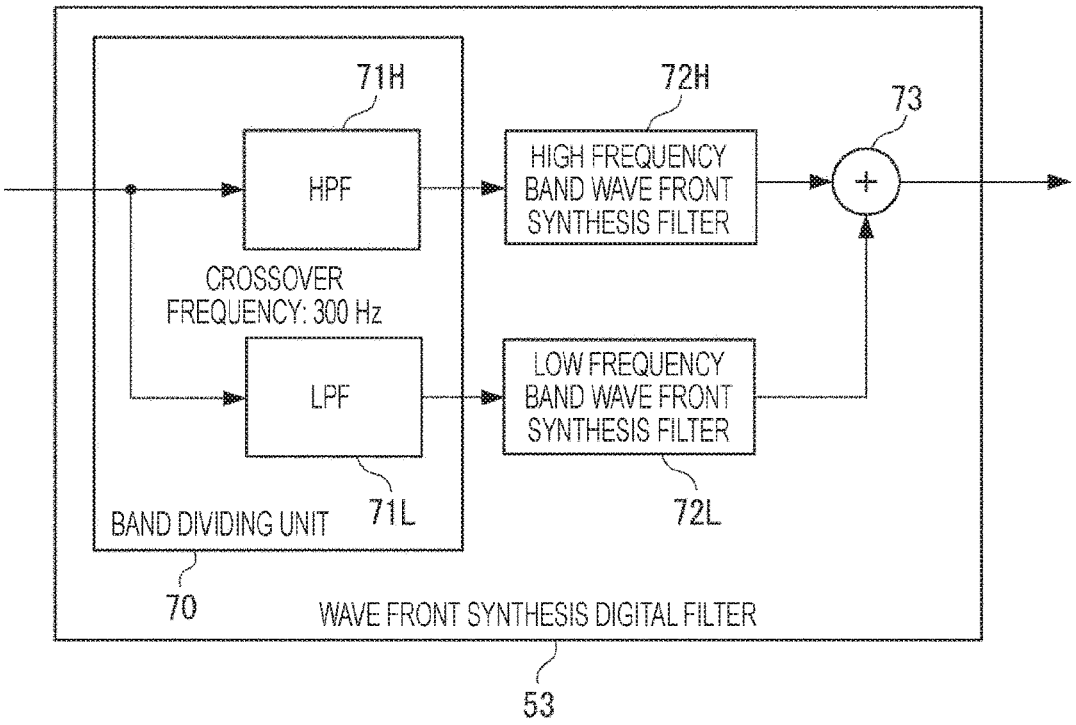
FIG. 4 is a block diagram illustrating a detailed exemplary configuration of a wave front synthesis digital filter.

FIG. 4 is a block diagram illustrating a detailed exemplary configuration of the wave front synthesis digital filter 53.

The wave front synthesis digital filter 53 includes a band dividing unit 70, a high frequency band wave front synthesis filter 72H, a low frequency band wave front synthesis filter 72L, and a synthesis unit 73.

The band dividing unit 70 includes a high pass filter (HPF) 71H and a low pass filter (LPF) 71L and divides the audio signal supplied from the controller 52 into signals in the plurality of bands corresponding to the respective units in the multi-way speaker 32.

Specifically, the HPF 71H performs filter processing to pass only a signal in the high frequency band side higher than or equal to the crossover frequency of 300 Hz of the multi-way speaker 32 from among the audio signals supplied from the controller 52. The HPF 71H supplies the audio signal after filter processing to the high frequency band wave front synthesis filter 72H.

The LPF 71L performs filter processing to pass only a signal in the low frequency band side lower than the crossover frequency of 300 Hz of the multi-way speaker 32 from among the audio signals supplied from the controller 52. The LPF 71L supplies the audio signal after filter processing to the low frequency band wave front synthesis filter 72L.

The high frequency band wave front synthesis filter 72H executes, on the audio signal in the high frequency band supplied from the HPF 71H, filter processing of the inverse function filter H_high designed for the high frequency band higher than or equal to the crossover frequency and supplies the audio signal after the filter processing to the synthesis unit 73.

The low frequency band wave front synthesis filter 72L executes, on the audio signal in the low frequency band supplied from the LPF 71L, filter processing of the inverse function filter H_low designed for a low frequency band lower than the crossover frequency and supplies the audio signal after the filter processing to the synthesis unit 73.

The synthesis unit 73 synthesizes (adds) the audio signal after the filter processing by the high frequency band wave front synthesis filter 72H and the audio signal after the filter processing by the low frequency band wave front synthesis filter 72L and outputs to the D/A converter 54 (FIG. 2).

<Detailed Exemplary Configuration of Multi-way Speaker>

Figure 5:
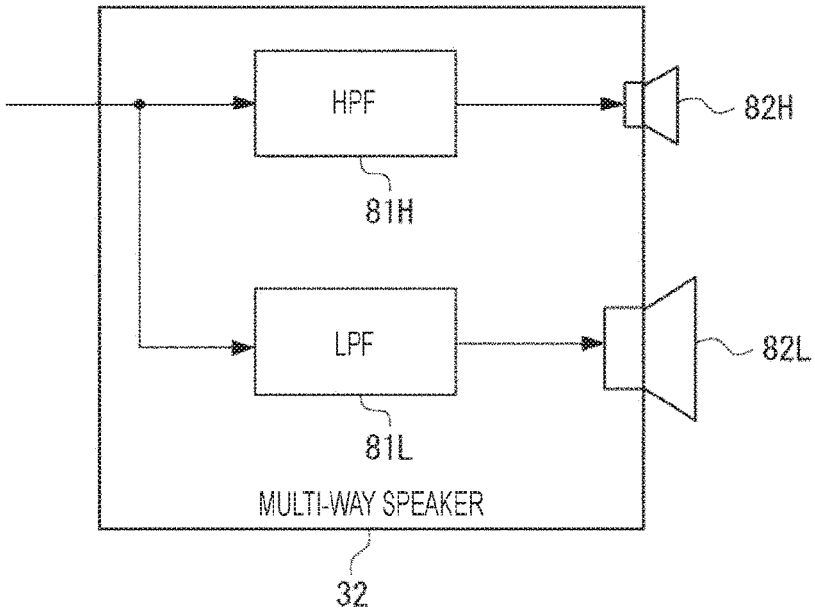
FIG. 5 is a diagram illustrating a detailed exemplary configuration of a multi-way speaker.

FIG. 5 is a diagram illustrating a detailed exemplary configuration of the multi-way speaker 32.

The multi-way speaker 32 includes a HPF 81H, a LPF 81L, a speaker unit 82H, and a speaker unit 82L.

The HPF 81H executes filter processing to pass only a signal in the high frequency band side higher than or equal to the crossover frequency of 300 Hz from among the audio signals supplied from the amplifier 55 in the signal processing device 31 and supplies the audio signal after the filter processing to the speaker unit 82H.

The LPF 81L executes filter processing to pass only a signal in the low frequency band side lower than the crossover frequency of 300 Hz from among the audio signals supplied from the amplifier 55 in the signal processing device 31 and supplies the audio signal after the filter processing to the speaker unit 82L.

The aforementioned HPF 71H and the LPF 71L of the wave front synthesis digital filter 53 are digital filters while the HPF 81H and the LPF 81L of the multi-way speaker 32 are analog filters.

The speaker unit 82H outputs sound corresponding to the audio signal in the high frequency band supplied from the HPF 81H.

The speaker unit 82L outputs sound corresponding to the audio signal in the low frequency band supplied from the LPF 81L.

Note that, according to the configurations in FIG. 4 and FIG. 5, audio signals divided into the high frequency band and the low frequency band corresponding to the speaker unit 82H and the speaker unit 82L, respectively, are once synthesized in the wave front synthesis digital filter 53 and then again divided into the high frequency band and the low frequency band in the multi-way speaker 32. However, the audio signals divided into the high frequency band and the low frequency band in the wave front synthesis digital filter 53 may be supplied to the HPF 81H and the LPF 81L of the multi-way speaker 32 as they are without being synthesized.

<Sound Field Reproduction Processing>

Figure 6:
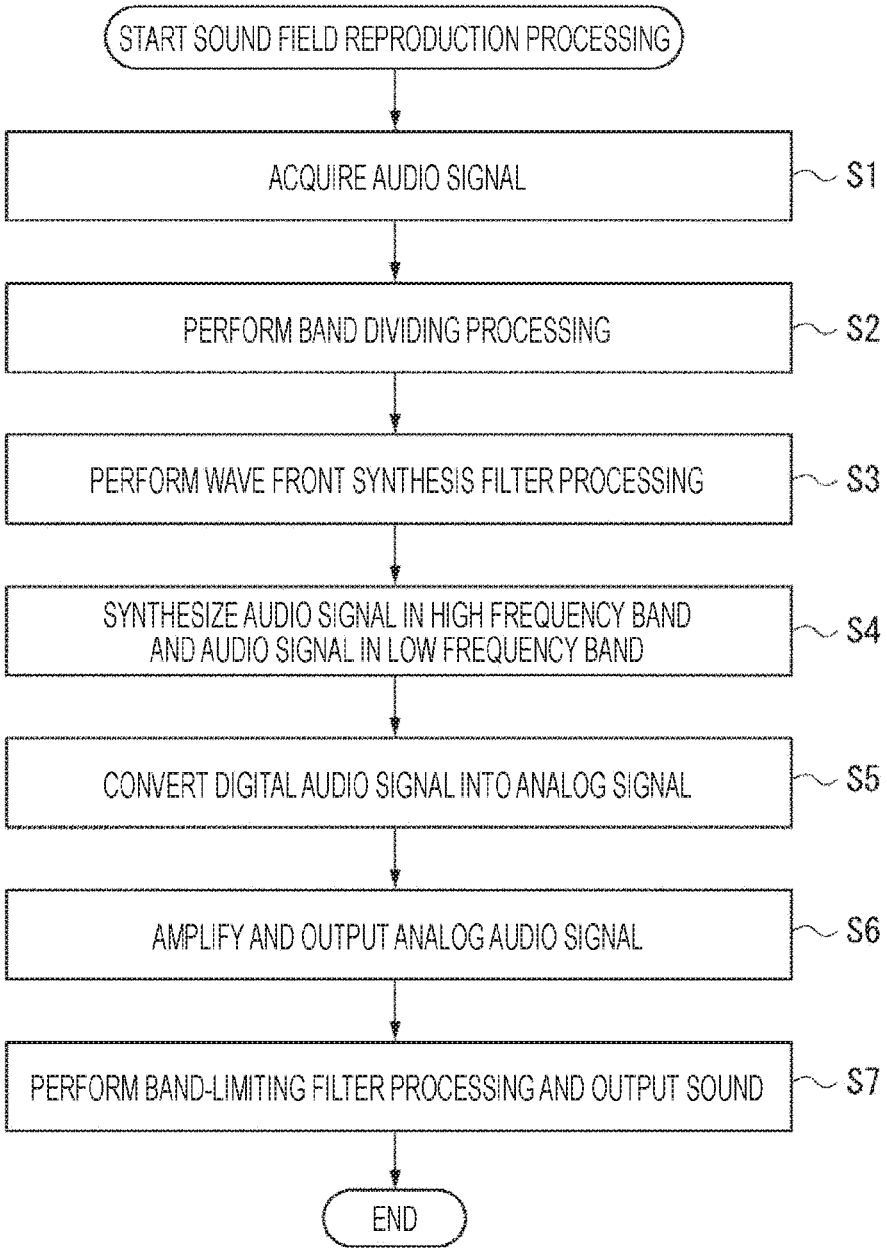
FIG. 6 is a flowchart explaining sound field reproduction processing by a reproduction system.

Next, sound field reproduction processing by the reproduction system 20 will be explained with reference to a flowchart in FIG. 6. This processing is initiated upon instruction of reproduction of a predetermined audio signal by a user at the operation unit (not illustrated), for example.

First in step S1, the controller 52 acquires, from the data storage unit 51, the predetermined audio signal of instructed by the user at the operation unit (not illustrated) and supplies the audio signal to the wave front synthesis digital filters $\mathbf{53}_1$ to $\mathbf{53}_N$.

In step S2, the band dividing unit 70 in the wave front synthesis digital filter 53 performs band dividing processing to divide the audio signal supplied from the controller 52 into signals in the plurality of bands.

That is, the HPF 71H performs filter processing to pass only a signal in the high frequency band side higher than or equal to the crossover frequency of 300 Hz of the multi-way speaker 32 from among the audio signals supplied from the controller 52 and supplies the audio signal after the filter processing to the high frequency band wave front synthesis filter 72H. That is, the LPF 71L performs filter processing to pass only a signal in the low frequency band side lower than the crossover frequency of 300 Hz of the multi-way speaker 32 from among the audio signals supplied from the controller 52 and supplies the audio signal after the filter processing to the low frequency band wave front synthesis filter 72L.

In step S3, the high frequency band wave front synthesis filter 72H and the low frequency band wave front synthesis filter 72L of the wave front synthesis digital filter 53 perform wave front synthesis filter processing by the inverse function filter $H=G^{-1}$ of the transmission function G in the reproduction space.

Specifically, the high frequency band wave front synthesis filter 72H performs, on the audio signal in the high frequency band supplied from the HPF 71H, filter processing of the inverse function filter H_high designed for the high frequency band higher than or equal to the crossover frequency and supplies the audio signal after the filter processing to the synthesis unit 73.

The low frequency band wave front synthesis filter 72L performs, on the audio signal in the low frequency band supplied from the LPF 71L, filter processing of the inverse function filter H_low designed for the low frequency band lower than the crossover frequency and supplies the audio signal after the filter processing to the synthesis unit 73.

In step S4, the synthesis unit 73 synthesizes the audio signal in the high frequency band after the filter processing by the high frequency band wave front synthesis filter 72H and the audio signal in the low frequency band after the filter processing by the low frequency band wave front synthesis filter 72L and outputs to the D/A converter 54.

In step S5, the D/A converter 54 converts the digital audio signal supplied from the synthesis unit 73 in the wave front synthesis digital filter 53 into an analog signal and supplies the analog signal to the amplifier 55.

In step S6, the amplifier 55 amplifies the analog audio signal supplied from the D/A converter 54 and outputs to the multi-way speaker 32 connected therewith.

In step S7, the multi-way speaker 32 outputs sound corresponding to the audio signal supplied from the amplifier 55.

Specifically, the HPF 81H of the multi-way speaker 32 executes filter processing to pass only a signal in the high frequency band side higher than or equal to the crossover frequency of 300 Hz from among the audio signals supplied from the amplifier 55 and outputs the audio signal after the filter processing as sound from the speaker unit 82H. Furthermore, the LPF 81L of the multi-way speaker 32 executes filter processing to pass only a signal in the low frequency band side lower than the crossover frequency of 300 Hz from among the audio signals supplied from the amplifier 55 and outputs the audio signal after the filter processing as sound from the speaker unit 82L.

The processing of steps S2 to S7 is executed in parallel in each of the N processing systems corresponding to the multi-way speakers $\mathbf{32}_1$ to $\mathbf{32}_N$.

The processing of steps S1 to S7 described above is executed continuously until no audio signal is supplied from the data storage unit 51. When no more audio signal is supplied, the sound field reproduction processing in FIG. 6 is terminated.

According to the reproduction system 20, the signal processing device 31 performs, on the speaker unit 82H that supports the high frequency band and the speaker unit 82L that supports the low frequency band in the multi-way speaker 32, wave front synthesis filter processing corresponding to each of the bands thereof as described above. This allows for obtaining better sound image localization. That is, an input signal suitable for the multi-way speaker can be generated.

<Calculation of Transmission Function G by Simulation Calculation>

As described above, it is often difficult to measure the transmission function G and thus there are cases where the transmission function G is derived from a simulation calculation using a theoretical value.

Figure 7:
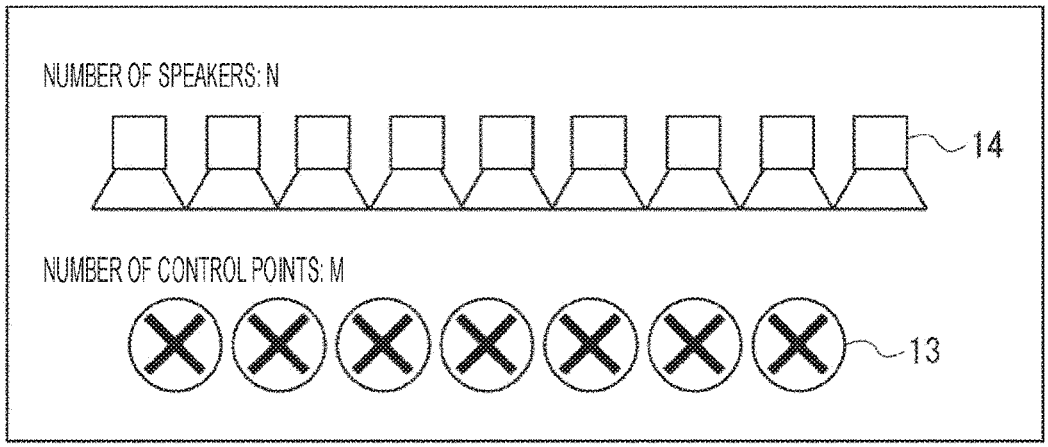
FIG. 7 is a diagram explaining calculation of a transmission function by simulation calculation.

When the transmission function G is derived by simulation calculation, usually N×M acoustic simulation formulas that includes the number of speakers 14 (N) and the number of control points (microphones) (M) as illustrated in FIG. 7 are calculated using a finite element method, a boundary element method, an FDTD method, or other methods and a pseudo inverse matrix thereof is solved.

Meanwhile, in the case of deriving transmission functions G that are different between the high frequency band and the low frequency band as in the present embodiment, it is assumed that a spherical wave is output from a unit position of each of the speaker unit 82H in the high frequency band and the speaker unit 82L in the low frequency band and thereby acoustic simulation formulas to the control points are generated.

In this case, N×M acoustic simulation formulas corresponding to the speaker unit 82H in the high frequency band and N×M acoustic simulation formulas corresponding to the speaker unit 82L in the low frequency band are generated and a pseudo inverse matrix thereof is solved. The computation amount is thus doubled.

In the low frequency band, however, the wavelength is long and thus the control points are not required to be dense as compared to those in the high frequency band. That is, the number of simulations may be small. An interval among the control points may be approximately half the wavelength.

Figure 8:
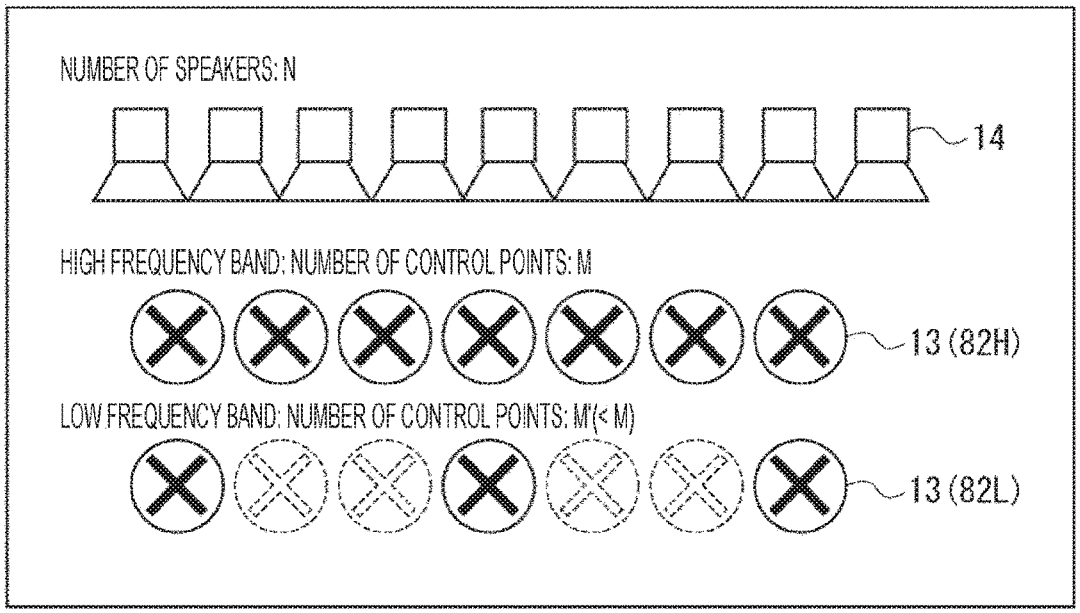
FIG. 8 is a diagram explaining calculation of the transmission function by simulation calculation.

For example when the crossover frequency is 300 Hz, calculation can be performed while the control points are thinned to an interval of approximately 50 cm in the simulation formulas in the low frequency band. As illustrated in FIG. 8, therefore, calculation can be performed with M' control points which is a smaller number than the actual number M in the simulation formula of the low frequency band side and thus the size of the matrix becomes smaller in calculation of a pseudo inverse matrix upon design of the filter. This allows for preferable calculation efficiency and shorter design time of the filter.

In the example described above, the case where the multi-way speaker 32 is a two-way speaker where the sound range is divided into two including the high frequency band and the low frequency band has been described; however, the above is similarly applicable even if the multi-way speaker 32 is a speaker where the sound range is divided into three or more frequency bands.

The series of processing described above may be executed by hardware or may be executed by software. When the series of processing is executed by software, a program that forms the software is installed in a computer. The computer here includes, for example, a computer incorporated in dedicated hardware, a generic personal computer capable of executing various functions by installing various programs, or other types of computers.

Figure 9:
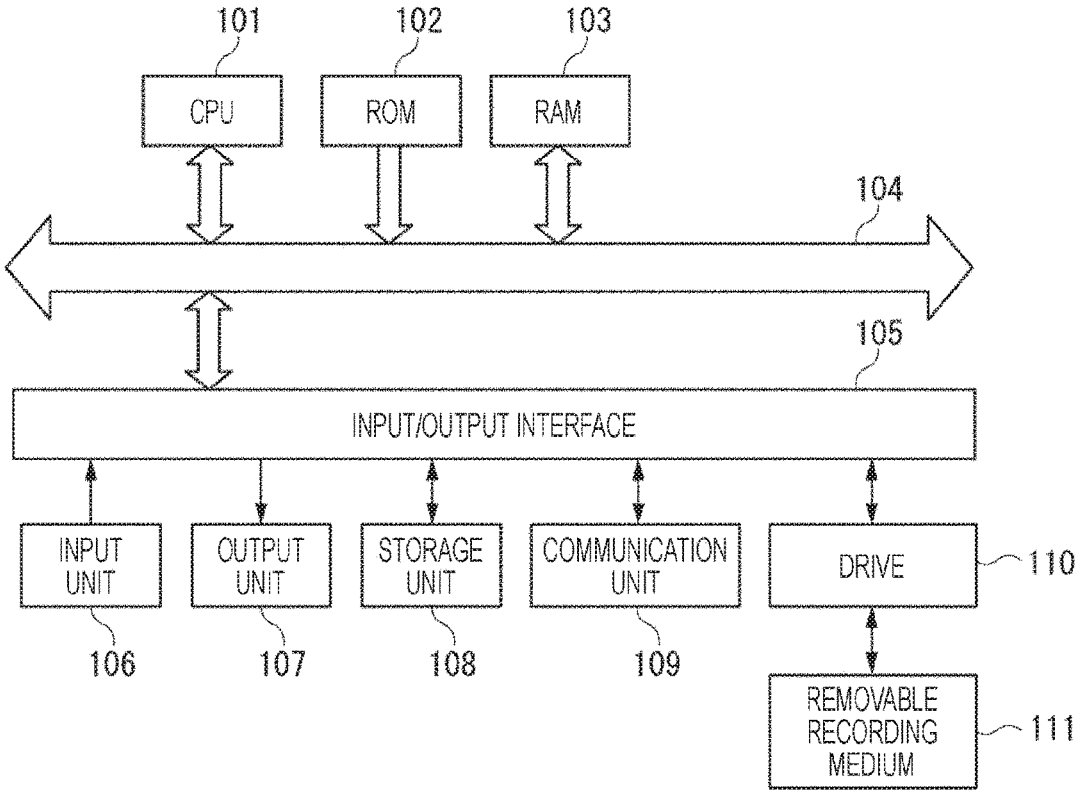
FIG. 9 is a block diagram illustrating an exemplary configuration of an embodiment of a computer according to the present disclosure.

FIG. 9 is a block diagram illustrating an exemplary configuration of hardware of a computer that executes the series of processing described above by a program.

In the computer, a central processing unit (CPU) 101, a read only memory (ROM) 102, and a random access memory (RAM) 103 are connected to each other by bus 104.

The bus 104 is further connected with an input/output interface 105. The input/output interface 105 connected with an input unit 106, an output unit 107, a storage unit 108, a communication unit 109, and a drive 110.

The input unit 106 includes a keyboard, a mouse, a microphone, or other devices. The output unit 107 includes a display, a speaker, or other devices. The storage unit 108 includes a hard disk, a nonvolatile memory, or others. The communication unit 109 includes a network interface or others. The drive 110 drives a removable recording medium 111 such as a magnetic disk, an optical disk, a magneto-optical disk, or a semiconductor memory.

In the computer configured in the above manner, the series of processing described above is performed by the CPU 101, for example, by loading a program stored in the storage unit 108 to the RAM 103 via the input/output interface 105 and the bus 104 and executing the program.

In the computer, a program can be installed in the storage unit 108 via the input/output interface 105 by mounting the removable recording medium 111 to the drive 110. Moreover, a program may be received by the communication unit 109 via a wired or wireless transmission medium such as a local area network, the Internet, and digital satellite broadcasting and installed in the storage unit 108. Alternatively, a program may be installed in the ROM 102 or the storage unit 108 in advance.

Note that the program executed by the computer may perform processing in time series according to the order described herein or may perform processing in parallel or at necessary timing such as upon a call.

Note that, in the present description, a system means a collection of a plurality of components (devices, modules (parts), or the like) regardless of whether all the components are in the same housing. Therefore, any one of a plurality of devices in separate housings and connected via a network and one device where a plurality of modules is included in one housing is a system.

Embodiments of the present disclosure are not limited to the aforementioned embodiments and may include various modifications within a scope not departing from the principles of the present disclosure.

For example, an embodiment where all or a part of the plurality of embodiments described above are combined may be employed.

For example, the present disclosure may employ cloud computing where one function is processed by a plurality of devices in a shared and collaborative manner via a network.

Moreover, each of the steps described in the above flowchart may be executed by one device or may be executed by a plurality of devices in a collaborative manner.

Furthermore, when a plurality of types processing is included in one step, the plurality of types of processing included in that one step may be executed in one device or may be executed by a plurality of devices in a collaborative manner.

Note that effects described herein are merely examples and thus are not limited. Effects other than those described herein may also be included.

Note that the present disclosure may be as follows.

(1)

A signal processing device, including:

a band dividing unit that divides an audio signal into signals in a plurality of bands corresponding to respective bands of a plurality of speaker units of a multi-way speaker; and a wave front synthesis filter processing unit that performs wave front synthesis filter processing on each of the audio signals in the respective bands having been divided into, wherein the audio signal in each of the bands after the wave front synthesis filter processing is supplied to the speaker unit of the corresponding band in the multi-way speaker.

(2)

The signal processing device according to item (1), further including:

a synthesis unit that synthesizes the audio signals in the respective bands after the wave front synthesis filter processing, wherein the audio signal after synthesis is supplied to the multi-way speaker.

(3)

The signal processing device according to item (1) or (2), wherein a filter of the wave front synthesis filter processing corresponding to the speaker unit of a low frequency band side from among the plurality of speaker units in the multi-way speaker is generated by simulation where the number of control points is set smaller than an actual number thereof.

(4)

A signal processing method, including the steps of:

dividing, by a signal processing device, an audio signal into signals in a plurality of bands corresponding to respective bands of a plurality of speaker units of a multi-way speaker; and performing, by the signal processing device, wave front synthesis filter processing on each of the audio signals in the respective bands having been divided into, wherein the audio signal in each of the bands after the wave front synthesis filter processing is supplied to the speaker unit of the corresponding band in the multi-way speaker.

(5)

A program for causing a computer to function as:

a band dividing unit that divides an audio signal into signals in a plurality of bands corresponding to respective bands of a plurality of speaker units of a multi-way speaker; and a wave front synthesis filter processing unit that performs wave front synthesis filter processing on each of the audio signals in the respective bands having been divided into, wherein the audio signal in each of the bands after the wave front synthesis filter processing is supplied to the speaker unit of the corresponding band in the multi-way speaker.

REFERENCE SIGNS LIST

13 Microphone
14 Speaker
20 Reproduction system
31 Signal processing device
32 Multi-Way speaker
52 Controller
53 Wave front synthesis digital filter
54 D/A converter
55 Amplifier
70 Band dividing unit
71H HPF
71L LPF
72H High frequency band wave front synthesis filter
72L Low frequency band wave front synthesis filter
73 Synthesis unit
82H, 82L Speaker unit
101 CPU
102 ROM
103 RAM
106 Input unit
107 Output unit
108 Storage unit
109 Communication unit
110 Drive

The invention claimed is:

1. A signal processing device, comprising:

circuitry configured to:

divide a first audio signal into a plurality of first signal bands, wherein each of the plurality of first signal bands corresponds to a respective second signal band of a plurality of second signal bands of a plurality of speakers of a multi-way speaker; and execute a wave front synthesis filter process on each of the plurality of first signal bands of the multi-way speaker, wherein each of the processed plurality of first signal bands is supplied to the respective second signal band of the plurality of second signal bands, and wherein a first cut-off frequency, between the divided plurality of first signal bands, is same as a second cut-off frequency that is between the plurality of second signal bands of the multi-way speaker.

2. The signal processing device according to claim 1, wherein the circuitry is further configured to synthesize the processed plurality of first signal bands to a second audio signal, wherein the second audio signal is supplied to the multi-way speaker.

3. The signal processing device according to claim 1, wherein the plurality of second signal bands includes a low frequency band, and wherein the circuitry is further configured to execute the wave front synthesis filter process, corresponding to the low frequency band of the multi-way speaker, based on a simulation matrix that comprises a number of control points, wherein the number of control points is generated based on a number of microphones, and wherein the number of control points is smaller than the number of microphones.

4. The signal processing device according to claim 1, wherein the circuitry is further configured to:

change the processed plurality of first signal bands into analog signals; and supply the analog signals to the multi-way speaker.

5. The signal processing device according to claim 1, wherein the plurality of second signal bands of the multi-way speaker includes a high frequency band and a low frequency band, wherein the high frequency band comprises a first acoustic axis, and the low frequency band comprises a second acoustic axis, and wherein the first acoustic axis is different from the second acoustic axis.

6. A signal processing method, comprising:

in a signal processing device:

dividing an audio signal into a plurality of first signal bands, wherein each of the plurality of first signal bands corresponds to a respective second signal band of a plurality of second signal bands of a plurality of speakers of a multi-way speaker; and executing a wave front synthesis filter process on each of the plurality of first signal bands, wherein each of the processed plurality of first signal bands is supplied to the respective second signal band of the plurality of second signal bands, and wherein a first cut-off frequency, between the divided plurality of first signal bands, is same as a second cut-off frequency that is between the plurality of second signal bands of the multi-way speaker.

7. A non-transitory computer-readable medium having stored thereon, computer-executable instructions, which when executed by a signal processing device, cause the signal processing device to execute operations, the operations comprising:

dividing an audio signal into a plurality of first signal bands, wherein each the plurality of first signal bands corresponds to a respective second signal band of a plurality of second signal bands of a plurality of speakers of a multi-way speaker; and executing a wave front synthesis filter process on each of the plurality of first signal bands, wherein each of the processed plurality of first signal bands is supplied to the respective second signal band of the plurality of second signal bands, and wherein a first cut-off frequency, between the divided plurality of first signal bands, is same as a second cut-off frequency that is between the plurality of second signal bands of the multi-way speaker.

* * * * *